US009477251B2

(12) United States Patent
Akahane

(10) Patent No.: US 9,477,251 B2
(45) Date of Patent: Oct. 25, 2016

(54) REFERENCE VOLTAGE CIRCUIT

(71) Applicant: FUJI ELECTRIC CO., LTD., Kawasaki-shi (JP)

(72) Inventor: Masashi Akahane, Matsumoto (JP)

(73) Assignee: FUJI ELECTRIC CO., LTD., Kawasaki-Shi (JP)

( * ) Notice: Subject to any disclaimer, the term of this patent is extended or adjusted under 35 U.S.C. 154(b) by 0 days.

(21) Appl. No.: 14/842,179

(22) Filed: Sep. 1, 2015

(65) Prior Publication Data

US 2015/0370279 A1 Dec. 24, 2015

Related U.S. Application Data

(63) Continuation of application No. PCT/JP2014/063927, filed on May 27, 2014.

(30) Foreign Application Priority Data

Jun. 20, 2013 (JP) ..... 2013-129723

(51) Int. Cl.
*G05F 3/18* (2006.01)

(52) U.S. Cl.
CPC ..... *G05F 3/185* (2013.01); *G05F 3/18* (2013.01)

(58) Field of Classification Search
CPC ..... G05F 1/561
See application file for complete search history.

(56) References Cited

U.S. PATENT DOCUMENTS 3,413,853 A * 12/1968 Rowell ..... G01K 7/20 374/183
3,420,104 A * 1/1969 Troemel ..... G01K 7/01 257/470
3,534,245 A * 10/1970 Limberg ..... G05F 3/18 323/314
3,577,062 A * 5/1971 Hoffman ..... G05F 3/18 323/231
3,829,717 A * 8/1974 Harrison ..... G05F 3/18 323/231
3,916,508 A * 11/1975 Conzelmann ..... G05F 1/468 219/121.19
4,300,491 A * 11/1981 Hara ..... F02P 19/02 123/179.21
4,562,400 A * 12/1985 Narasimhan ..... G05F 1/567 323/231
4,626,663 A * 12/1986 Tateda ..... G05D 23/24 219/492
4,710,622 A * 12/1987 Imamura ..... G01V 8/20 250/214 C
5,198,728 A * 3/1993 Bernitz ..... H05B 41/392 315/291
5,359,327 A * 10/1994 Brown ..... G05F 3/18 327/326
5,365,420 A * 11/1994 Cadman ..... G05F 1/56 363/50

(Continued)

FOREIGN PATENT DOCUMENTS

JP H06-309049 A 11/1994
JP 2009-048464 A 3/2009

(Continued)

*Primary Examiner* — Thomas J Hiltunen
(74) *Attorney, Agent, or Firm* — Rabin & Berdo, P.C.

(57) ABSTRACT

A reference voltage circuit including a constant voltage circuit and a resistance voltage divider circuit. The constant voltage circuit includes a Zener diode, and a bias current circuit connected in series with the Zener diode and causing a constant current to flow into the Zener diode. The resistance voltage divider circuit is connected in parallel with the Zener diode, and includes first and second resistors connected in series. The first resistor is connected to a cathode side of the Zener diode, and is formed of a low temperature coefficient resistor body that is temperature-independent. The second resistor is connected to an anode side of the Zener diode, and is formed of a resistor body having temperature characteristics that are the reverse of output temperature characteristics of the Zener diode.

10 Claims, 14 Drawing Sheets

(56) References Cited

U.S. PATENT DOCUMENTS 5,519,313 A 5/1996 Wong et al.
5,621,307 A * 4/1997 Beggs ..... G05F 3/18 323/313
5,869,969 A * 2/1999 Cividino ..... H02J 7/0091 320/153
6,055,186 A * 4/2000 Hung ..... G11C 16/30 365/185.18
6,078,150 A * 6/2000 Koyanagi ..... H04B 10/503 315/169.3
6,242,870 B1 * 6/2001 Koyanagi ..... H05B 33/0812 315/149
6,441,593 B1 * 8/2002 Saripella ..... G05F 3/205 323/268
8,289,256 B2 * 10/2012 Jeong ..... G09G 3/3674 345/101
8,861,164 B2 * 10/2014 Mikolajczak ..... H02H 3/20 361/103
2006/0289461 A1 * 12/2006 Kojima ..... G01K 7/01 219/497
2009/0051343 A1 2/2009 Nagumo

FOREIGN PATENT DOCUMENTS

JP 4765168 B2 9/2011
JP 2013-030091 A 2/2013

* cited by examiner

REFERENCE VOLTAGE CIRCUIT

CROSS-REFERENCE TO RELATED APPLICATIONS

This application is a continuation application under 35 U.S.C. 120 of International Application PCT/JP2014/063927 having the International Filing Date of May 27, 2014, and claims the priority of Japanese Patent Application No. JP PA 2013-129723, filed on Jun. 20, 2013. The identified applications are fully incorporated herein by reference.

BACKGROUND OF THE INVENTION

1. Technical Field

The present invention relates to a reference voltage circuit of a simple configuration such that a predetermined reference voltage can be stably generated, regardless of power supply voltage fluctuation or temperature change.

2. Background Art

Reference voltage circuits that generate a predetermined reference voltage are widely used in various kinds of electronic circuit as circuits that regulate threshold voltage set in, for example, a comparator, and the like. As this kind of reference voltage circuit, it is proposed that a depletion type MOSFET (metal-oxide-semiconductor field-effect transistor) 1 and an enhancement type MOSFET 2 are combined as shown in, for example, FIG. 13, and a reference voltage Vref is generated utilizing the difference between the threshold voltages of the MOSFETs 1 and 2 (refer to Japanese Patent No. 4,765,168). However, a reference voltage circuit disclosed in Japanese Patent No. 4,765,168 is such that it is necessary to form the depletion type MOSFET 1 in addition to the enhancement type MOSFET 2 on a circuit element substrate, because of which there is a problem in that the cost of the manufacturing process thereof, and the like, soars.

Meanwhile, there is also a reference voltage circuit constructed to include multiple enhancement type MOSFETs 3*a* to 3*d*, which form a current mirror circuit and carry out a constant current operation, and multiple bipolar transistors 4*a* to 4*d* connected in series to the MOSFETs 3*a* to 3*d* respectively, as shown in FIG. 14 (refer to Japanese Patent Application No. JP-A-2009-48464). The reference voltage circuit disclosed in JP-A-2009-48464, by utilizing constant voltage operation at the base-emitter voltage of each of the bipolar transistors 4*a* to 4*d*, generates a constant reference voltage Vref from the output of the current mirror circuit, regardless of fluctuation in a power supply voltage Vcc.

BRIEF SUMMARY OF THE INVENTION

Technical Problem

Herein, as a power supply device that drives an alternating current load of a motor or the like, there is, for example, a power converter wherein input direct current power is switched via first and second switch elements connected in series to form a half-bridge circuit, thereby supplying alternating current power to a load connected to a midpoint of the half-bridge circuit. Herein, the first and second switch elements are formed of, for example, high breakdown voltage IGBTs (insulated-gate bipolar transistors) or MOSFETs. Further, the first and second switch elements are alternately driven so as to be turned on by, for example, a drive control circuit realized as a power supply IC (integrated circuit).

Also, for example, a protective circuit for protecting the load and switch elements from overcurrent and the like by prohibiting a turn-on drive of the switch elements when the current flowing into the switch elements exceeds a predetermined value has heretofore commonly been incorporated in this kind of drive control circuit. The previously mentioned reference voltage Vref is utilized as a detection threshold voltage of the overcurrent in this kind of protective circuit.

However, when the reference voltage circuit of the configuration shown in, for example, FIG. 14 is incorporated in a high side driver circuit in the drive control circuit that drives each of the first and second switch elements so as to be turned on, there is concern that the following kinds of problem will occur.

That is, the high side driver circuit is configured so as to carry out a floating operation with the midpoint voltage of the half-bridge circuit as a reference potential. Therefore, current flows in accompaniment to on/off operations of the high side switch elements in a high side region, in which the high side driver circuit is formed, of a circuit element substrate on which the drive control circuit is constructed. Therefore, the potential of the high side region of the circuit element substrate fluctuates due to the current, and the reference potential of the high side driver circuit that carries out a floating operation as previously mentioned, and thus the drive power supply voltage of the driver circuit, fluctuates. Also, displacement current caused by a negative voltage surge accompanying on/off operations of the high side switch elements is liable to occur in the high side region. Therefore, it cannot be denied that, as the bipolar transistors 4*a* to 4*d* malfunction due to reference potential fluctuation caused by the voltage fluctuation and displacement current, the reference voltage Vref fluctuates.

The invention, having been contrived bearing in mind this kind of situation, provides a reference voltage circuit of a simple configuration such that a constant reference voltage can be stably generated, regardless of power supply voltage fluctuation or temperature change, without using a depletion type MOSFET or bipolar transistor.

Solution to Problem

In order to achieve the heretofore described object, a reference voltage circuit according to the invention includes a constant voltage circuit, formed of a Zener diode and a bias current circuit connected in series with the Zener diode and causing a constant current to flow into the Zener diode, interposed between a reference potential and a power supply voltage and generating a predetermined breakdown voltage in the Zener diode, and includes a resistance voltage divider circuit, formed of first and second resistors connected in series, connected in parallel with the Zener diode and dividing the breakdown voltage generated in the Zener diode, thereby generating a reference voltage.

In particular, the reference voltage circuit according to the invention is characterized in that a low temperature coefficient resistor body whose resistance temperature coefficient can be taken to be zero (0) is used as the first resistor connected to the cathode side of the Zener diode in the resistance voltage divider circuit, and a resistor body having temperature characteristics the reverse of the output temperature characteristics of the Zener diode is used as the second resistor connected to the anode side of the Zener diode.

Herein, the bias current circuit is formed of a MOSFET driven by a predetermined bias voltage being applied.

Also, the reference voltage circuit according to the invention is characterized by further including a trimming circuit that regulates the resistance values of the first and second resistors in the resistance voltage divider circuit. The trimming circuit is preferably formed of a first switch element group, connected in series, that selectively bypasses a plurality of resistor bodies forming the first resistor, and a second switch element group, connected in series, that selectively bypasses a plurality of resistor bodies forming the second resistor. Preferably, the first and second switch element groups are realized as a plurality of MOSFETs each set so as to be turned on and off in accordance with a trimming control signal provided from the exterior.

More specifically, a plurality of resistor bodies forming each of the first and second resistors are configured as, for example, a pair of a low temperature coefficient resistor body whose resistance temperature coefficient can be taken to be zero (0) and a resistor body having temperature characteristics the reverse of the output temperature characteristics of the Zener diode and having a resistance value the same as that of the low temperature coefficient resistor body at a predetermined temperature. Further, it is preferable that the trimming circuit is provided so as to selectively bypass one of the low temperature coefficient resistor body and resistor body forming the pair.

Preferably, a plurality of pairs of the low temperature coefficient resistor body and resistor body are provided with differing resistance values, and it is desirable that the trimming circuit is provided so as to selectively bypass one of the low temperature coefficient resistor body and resistor body in each pair.

Advantageous Effects of Invention

As the reference voltage circuit of the heretofore described configuration is configured without using a depletion type MOSFET or bipolar transistor, the manufacturing process cost thereof can be kept low. Also, there is no occurrence of the existing problem caused by bipolar transistor malfunction. Based on this, a reference voltage Vref is generated via the low temperature coefficient resistor body utilizing the Zener diode and a resistor body having temperature characteristics the reverse of those of the Zener diode, because of which a constant reference voltage Vref can always be stably generated, regardless of fluctuation in the power supply voltage, or the like. Consequently, a constant reference voltage Vref can be stably generated even when the reference voltage circuit is incorporated in a high side drive circuit, or the like, that carries out a floating operation as previously described, because of which the previously mentioned overcurrent detection, and the like, can be stably executed. Moreover, the configuration of the reference voltage circuit is simple, the temperature characteristics of the reference voltage Vref can be easily regulated by a trimming circuit, and temperature dependency of the reference voltage Vref can be eliminated. Therefore, there are a large number of practical advantages.

DETAILED DESCRIPTION OF THE INVENTION

Figure 1:
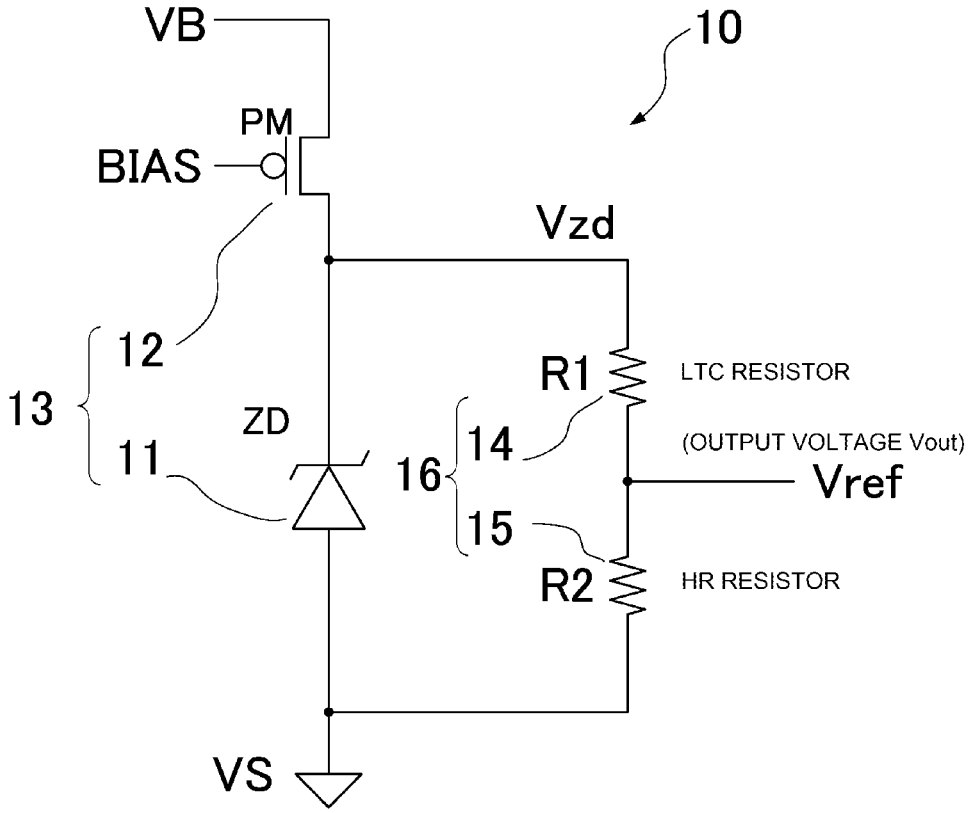
FIG. 1 is a schematic configuration diagram of a reference voltage circuit according to a first embodiment of the invention.

Hereafter, referring to the drawings, a description will be given of a reference voltage circuit according to embodiments of the invention.

FIG. 1 is a schematic view showing a basic configuration of a reference voltage circuit 10 according to a first embodiment of the invention, wherein 11 is a Zener diode (ZD). Also, 12 is a bias current circuit that is connected in series to the cathode of the Zener diode 11 and causes a constant current to flow into the Zener diode 11. The bias current circuit 12 is formed of, for example, a p-channel enhancement type MOSFET (PM) that operates by a predetermined bias voltage being applied to the gate thereof. A series circuit formed of the bias current circuit 12 and Zener diode 11 configures a constant voltage circuit 13, which is interposed between a reference potential VS and a power supply voltage VB and generates a predetermined breakdown voltage Vzd in the Zener diode 11.

Also, a resistance voltage divider circuit 16 connected in parallel to the Zener diode 11 is formed of a serially connected first resistor 14 of a resistance value R1 and second resistor 15 of a resistance value R2, and fulfils a role of dividing the breakdown voltage Vzd generated in the Zener diode 11, thereby generating a reference voltage Vref. Herein, the first resistor 14 connected to the cathode side of the Zener diode 11 is formed of an LTC (Low Temperature Coefficient) resistance element whose resistance temperature coefficient can be taken to be zero (0), that is, a low temperature coefficient resistor body called an LTC resistor. Also, the second resistor 15 connected to the anode side of the Zener diode 11, which is a general HR (High Resistance) element having a resistance temperature coefficient whose resistance value decreases in accordance with an increase in temperature, is formed of a resistor body called an HR resistor.

Herein, the HR resistor is realized as, for example, a metal thin film resistor or metal glaze resistor. As opposed to this, the LTC resistor is generally such that, for example, by forming polysilicon utilized in a gate electrode of a MOSFET in a region other than a gate oxide film, the polysilicon is utilized as a resistor. At this time, an increase in resistance is achieved by implanting an impurity into the polysilicon as appropriate. This kind of LTC resistor is as introduced in detail in, for example, Japanese Patent Application No. JP-A-2008-227061.

Herein, temperature characteristics $f_{ZD}(T)$, $f_{LTC}(T)$, and $f_{HR}(T)$ of the Zener diode 11, first resistor 14 formed of an LTC resistor, and second resistor 15 formed of an HR resistor respectively can exhibit the following linear functions in terms of a temperature T.

$$f_{ZD}(T)=az\times T+bz \tag{1}$$

$$f_{LTC}(T)=a1(b1\cdot s1)\times T+b1 \tag{2}$$

$$f_{HR}(T)=a2(b2\cdot s2)\times T+b2 \tag{3}$$

Note that in the above expressions, az is the temperature coefficient of the Zener diode 11, for example, 3.14(mV/° C.), while bz is the nominal breakdown voltage of the Zener diode 11, for example, 7.127(V). Also, a1 is the temperature coefficient per unit area of the first resistor 14 formed of an LTC resistor, for example, −0.0005(%/° C.). Furthermore, b1 is the nominal resistance value R1 of the first resistor 14, and s1 is the resistance value per unit area of the first resistor 14, for example 430(Ω).

Also, a2 is the temperature coefficient per unit area of the second resistor 15 formed of an HR resistor, for example, −0.0112(%/° C.), b2 is the nominal resistance value R2 of the second resistor 15, and s2 is the resistance value per unit area of the second resistor 15, for example 1,700(Ω). The temperature coefficient az of the Zener diode 11 is constant, regardless of the size of the Zener diode 11. However, the temperature coefficients a1 (b1·s1) and a2 (b2·s2) of the first resistor 14 and second resistor 15 respectively change depending on the dimensions of the resistance element, specifically, the horizontal to vertical ratio and resistance value of the resistance element, as shown in the above expressions.

Figure 2:
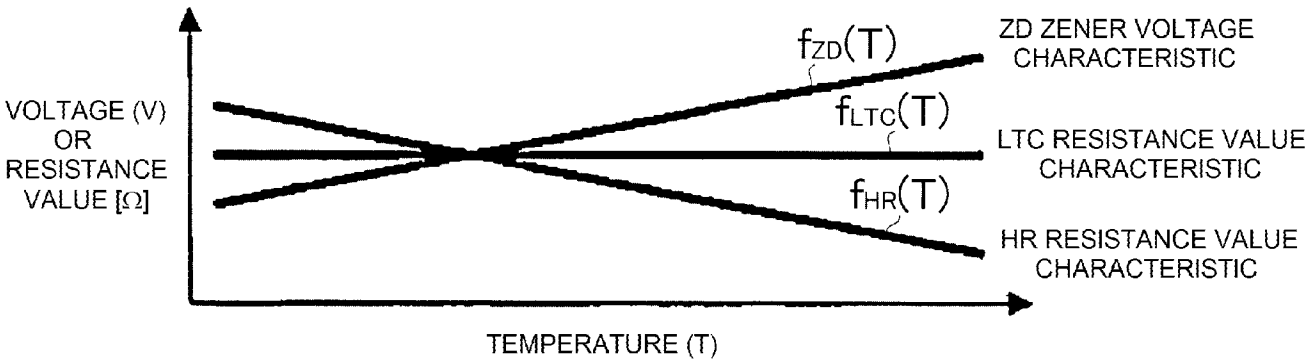
FIG. 2 is a diagram showing temperature characteristics of each portion in the reference voltage circuit shown in FIG. 1.

Consequently, the breakdown voltage Vzd generated in the Zener diode 11 manifests a positive change in accompaniment to a rise in the temperature T, as shown by the temperature characteristic $f_{ZD}(T)$ shown in, for example, FIG. 2. As opposed to this, as the resistance value R1 of the first resistor 14 formed of an LTC resistor is practically constant without depending on a change in the temperature T, as shown by the temperature characteristic $f_{LTC}(T)$, the temperature dependency thereof can be taken to be zero (0). Further, the resistance value R2 of the second resistor 15 formed of an HR resistor manifests a negative change in accompaniment to a rise in the temperature T, as shown by the temperature characteristic $f_{HR}(I)$. In other words, the second resistor 15 has a negative temperature characteristic $f_{HR}(T)$, the reverse of the positive temperature characteristic $f_{ZD}(T)$ of the Zener diode 11.

Figure 3:
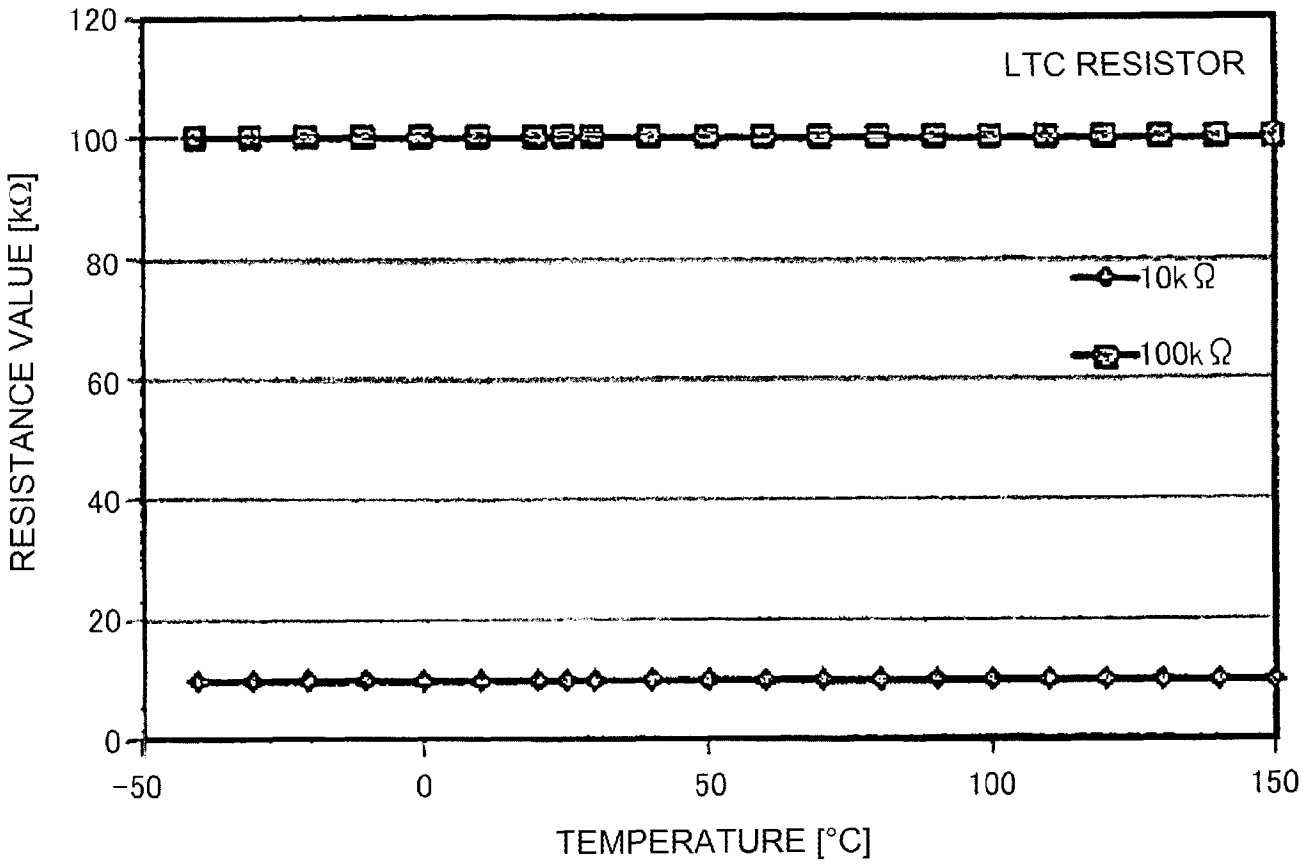
FIG. 3 is a diagram showing temperature characteristics of a low temperature coefficient (LTC) resistor body.

FIG. 3 shows actual measurement values with respect to temperature change of the first resistor 14 formed of LTC resistors of which the resistance value R1 is 10 kΩ and 100 kΩ. From the characteristics shown in FIG. 3, it can be confirmed that the temperature characteristics of the first resistor 14 are practically constant, regardless of the resistance value R1 thereof.

Figure 4:
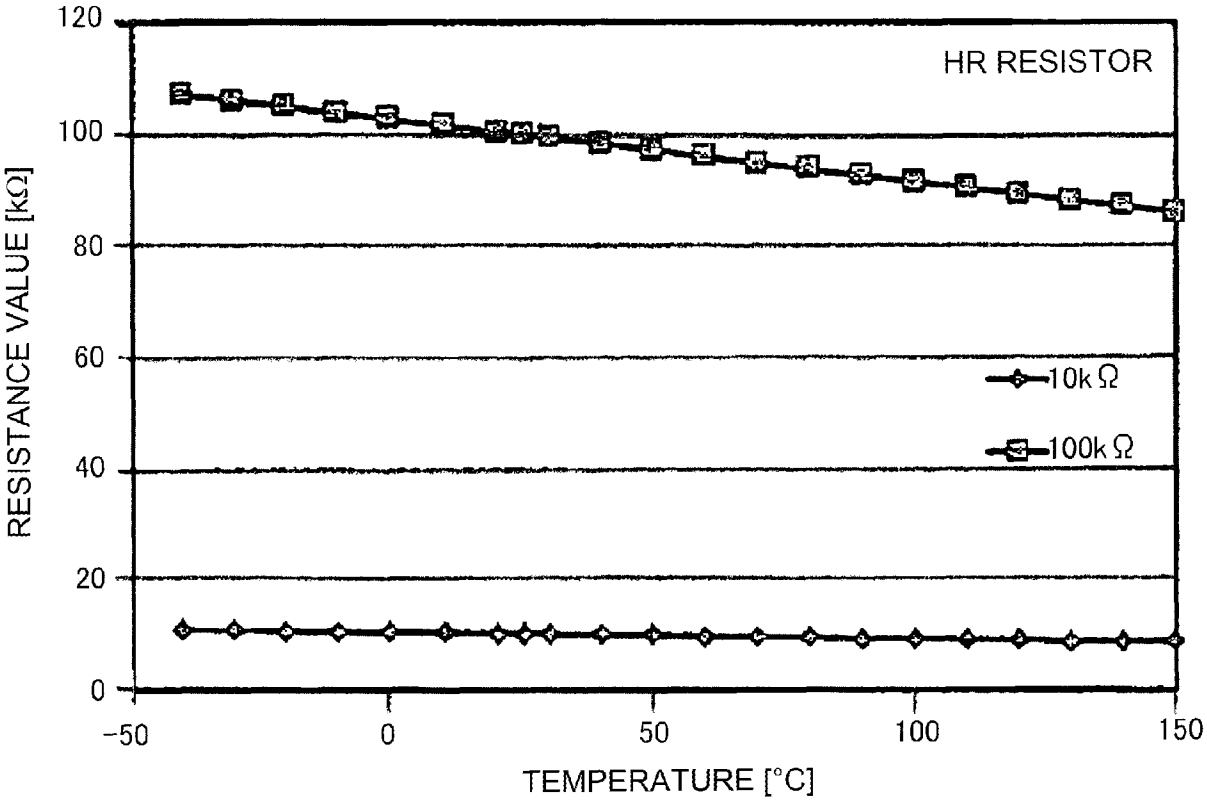
FIG. 4 is a diagram showing temperature characteristics of a resistor (a High Resistance resistor).

Also, FIG. 4 shows actual measurement values with respect to temperature change of the second resistor 15 formed of HR resistors of which the resistance value R2 is 10 kΩ and 100 kΩ. From the characteristics shown in FIG. 4, it is shown that the temperature characteristics of the second resistor 15 are such that the resistance temperature coefficient changes depending on the resistance value R2 of the second resistor 15, and is inversely proportional to the resistance value R2.

Herein, as the breakdown voltage generated in the Zener diode 11 is Vzd, the reference voltage Vref generated by the reference voltage circuit 10 with the configuration shown in FIG. 1, that is, an output voltage Vout of the resistance voltage divider circuit 16, is $$\begin{aligned} Vout &= \{R2/(R1+R2)\}\times Vzd \\ &= N\times Vzd. \end{aligned} \tag{4}$$

Note that N is the resistance voltage division ratio {R2/(R1+R2)} of the resistance voltage divider circuit 16.

Also, when taking a temperature coefficient $f_n(T)$ of the resistance voltage division ratio N to be $$f_n(T)=an\times T+bn,$$

the output voltage Vout can be expressed as $$\begin{aligned} Vout &= f_n(T)\times Vzd \\ &= f_n(T)\times f_{ZD}(T) \\ &= (an\times T+bn)\times(az\times T+bz) \\ &= (an\cdot az\times T^2+an\cdot bz\times T+ \\ &\quad bn\cdot az\times T+bz\cdot bz \end{aligned} \tag{5}$$

Consequently, when obtaining a temperature characteristic $f_{Vout}(T)$ of the output voltage Vout by differentiating Expression (5), $$\begin{aligned} f_{Vout}(T) &= dVout/dT \\ &= 2\cdot an\cdot az\times T+an\cdot bz+bn\cdot az \\ &= an(2\cdot az\times T+bz)+bn\cdot az. \end{aligned} \tag{6}$$

Further, when calculating ideal temperature coefficients of the resistance voltage divider circuit 16 at multiple temperatures T, specifically temperatures T of, for example, −40° C., 0° C., 25° C., and 150° C., from the temperature characteristic $f_{Vout}(T)$ of the output voltage Vout shown in Expression (6) based on the actual temperature characteristics of the Zener diode 11, the temperature coefficients are calculated to be, for example, as follows.

TABLE 1

| Ambient Temperature (° C.) | Temperature Coefficient an (%/° C.) |
|---|---|
| −40 | $-6.4065 \times 10^{-3}$ |
| 0 | $-6.1807 \times 10^{-3}$ |
| 25 | $-6.0475 \times 10^{-3}$ |
| 150 | $-5.4591 \times 10^{-3}$ |

Figure 5:
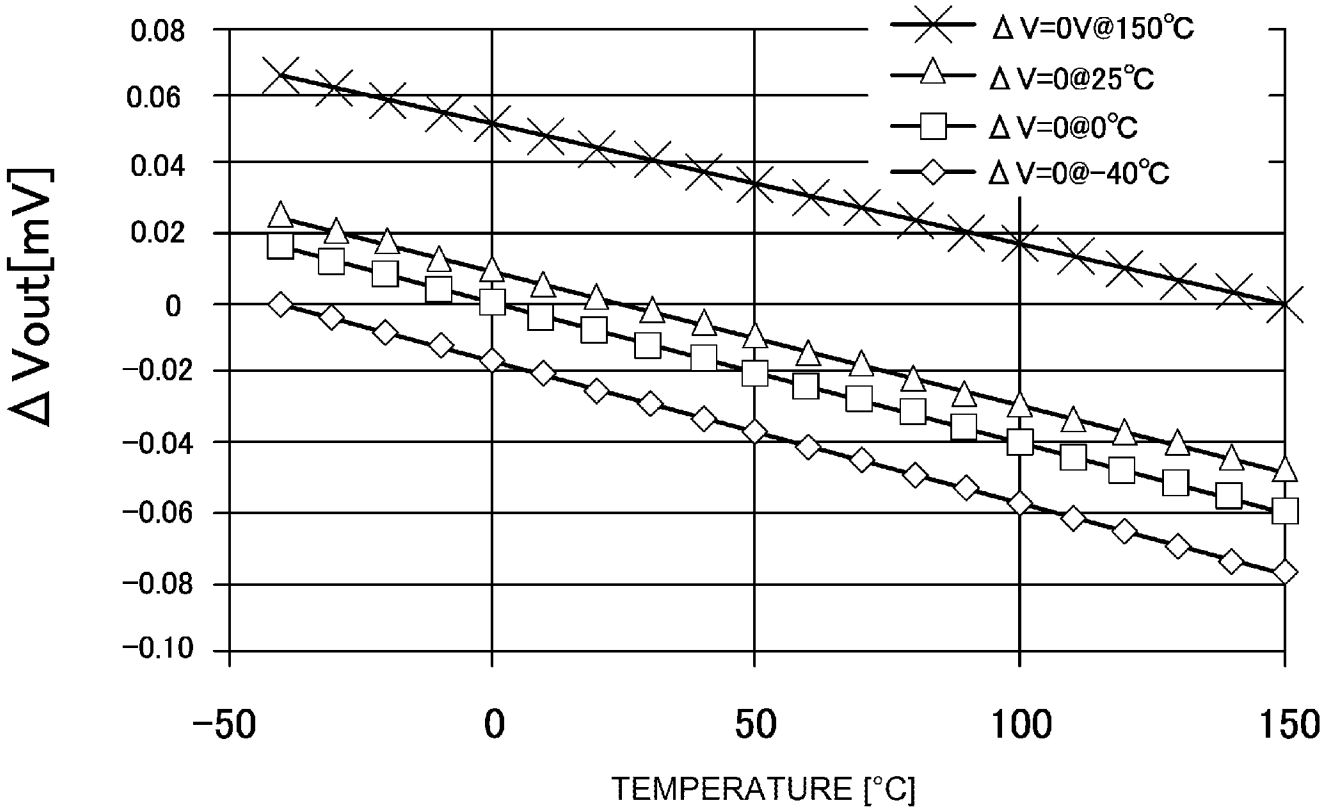
FIG. 5 is a diagram showing temperature characteristics of a fluctuation amount ΔVout of a reference voltage Vref, which is an output voltage Vout of the reference voltage circuit.

Consequently, assuming that the temperature coefficient an of the resistance voltage divider circuit 16 changes in accordance with the temperature T, as shown in Table 1, the output voltage Vout is constant regardless of temperature change, and an error ΔVout of the output voltage is zero (0). However, assuming that the temperature coefficient an of the resistance voltage divider circuit 16 has a constant value obtained for each temperature T shown in Table 1, the error ΔVout of the output voltage Vout changes as shown in, for example, FIG. 5.

Figure 6:
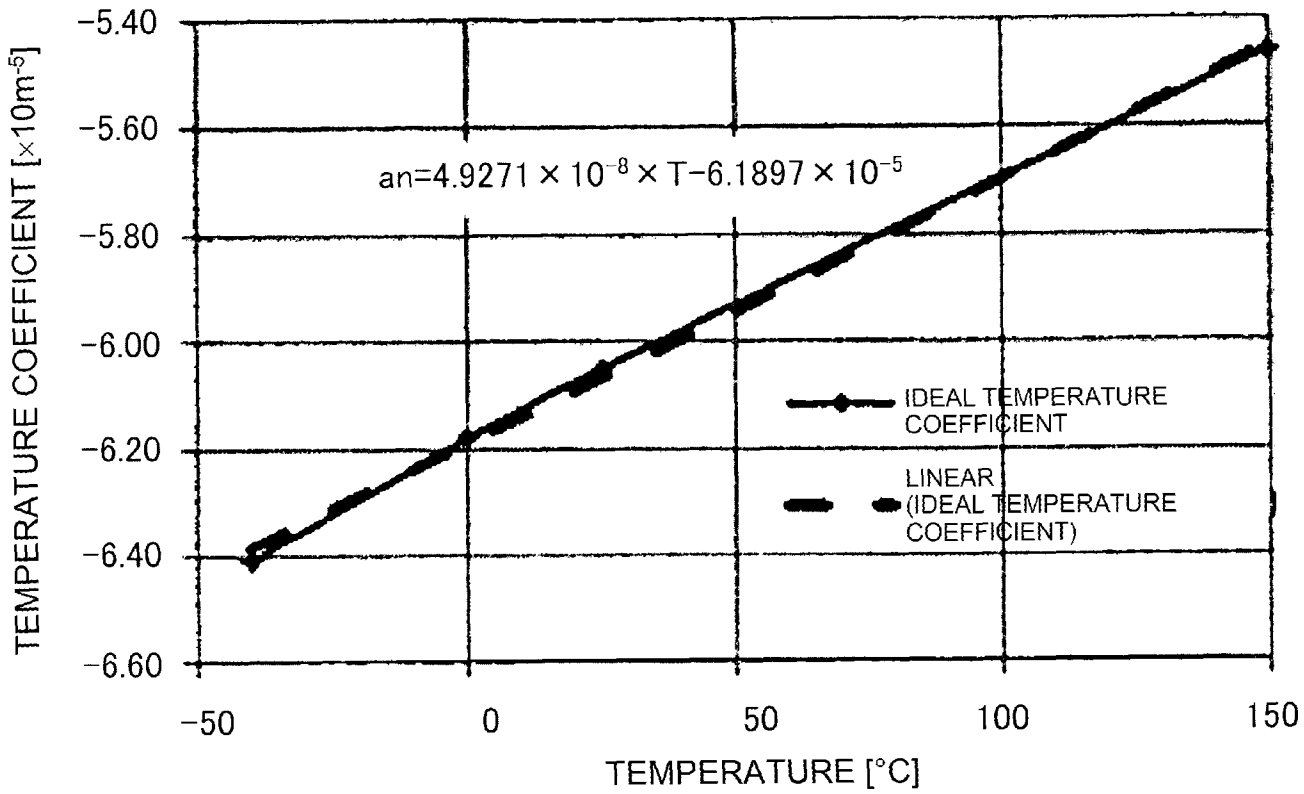
FIG. 6 is a diagram showing ideal temperature characteristics of a voltage division resistance rate wherein the fluctuation amount ΔVout of the reference voltage Vref, which is the output voltage Vout of the reference voltage circuit, is taken to be zero (0).

That is, the previously mentioned ideal temperature coefficients an of the resistance voltage divider circuit 16 shown in Table 1 wherein the error ΔVout of the output voltage Vout is zero (0) change depending on the temperature T (° C.), as shown in FIG. 6. Further, the change is practically linear, as approximated by the linear expression $$an=4.9271\times10^{-8}\times T-6.1897\times10^{-5}.$$

Figure 7:
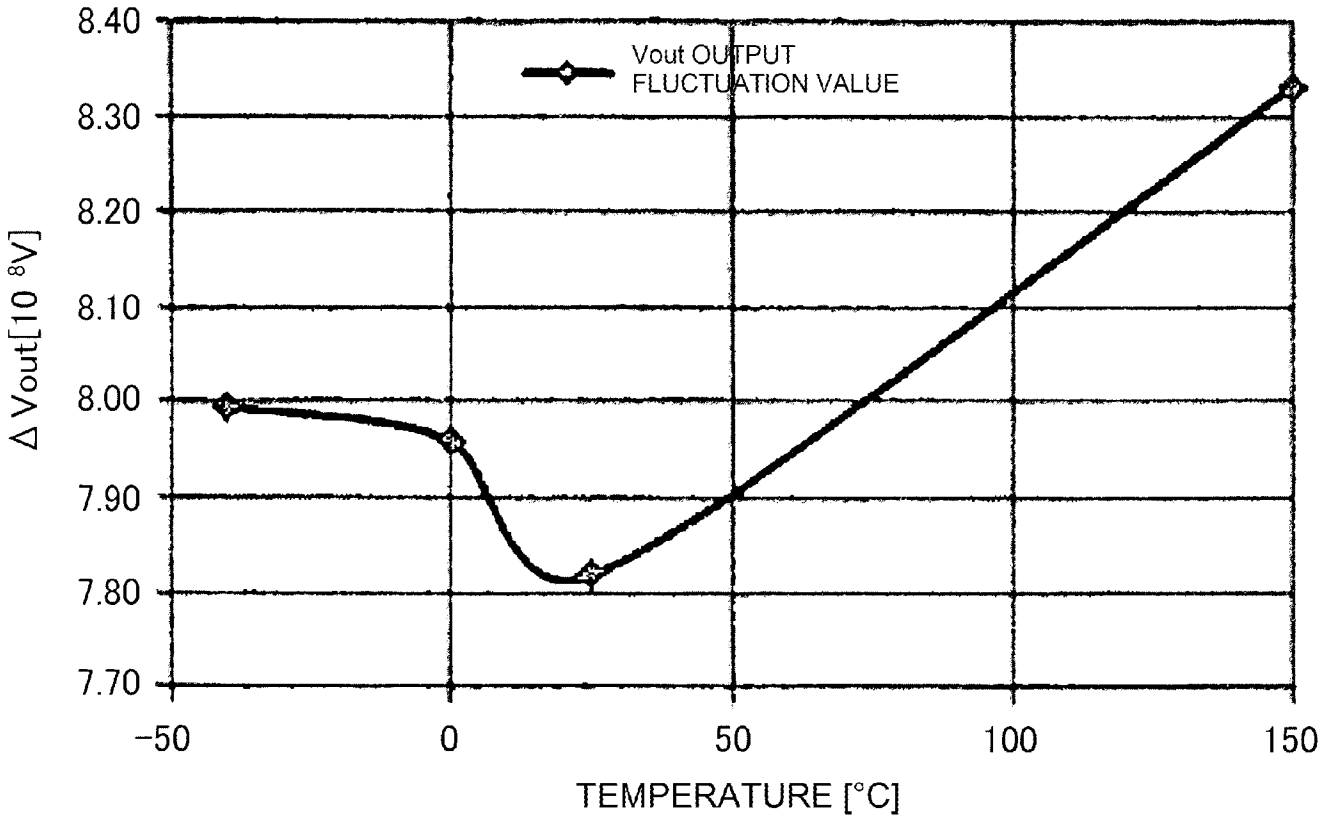
FIG. 7 is a diagram showing the fluctuation amount ΔVout of the reference voltage Vref, which is the output voltage Vout of the reference voltage circuit, when the voltage division resistance rate has the ideal temperature characteristics.
Figure 8:
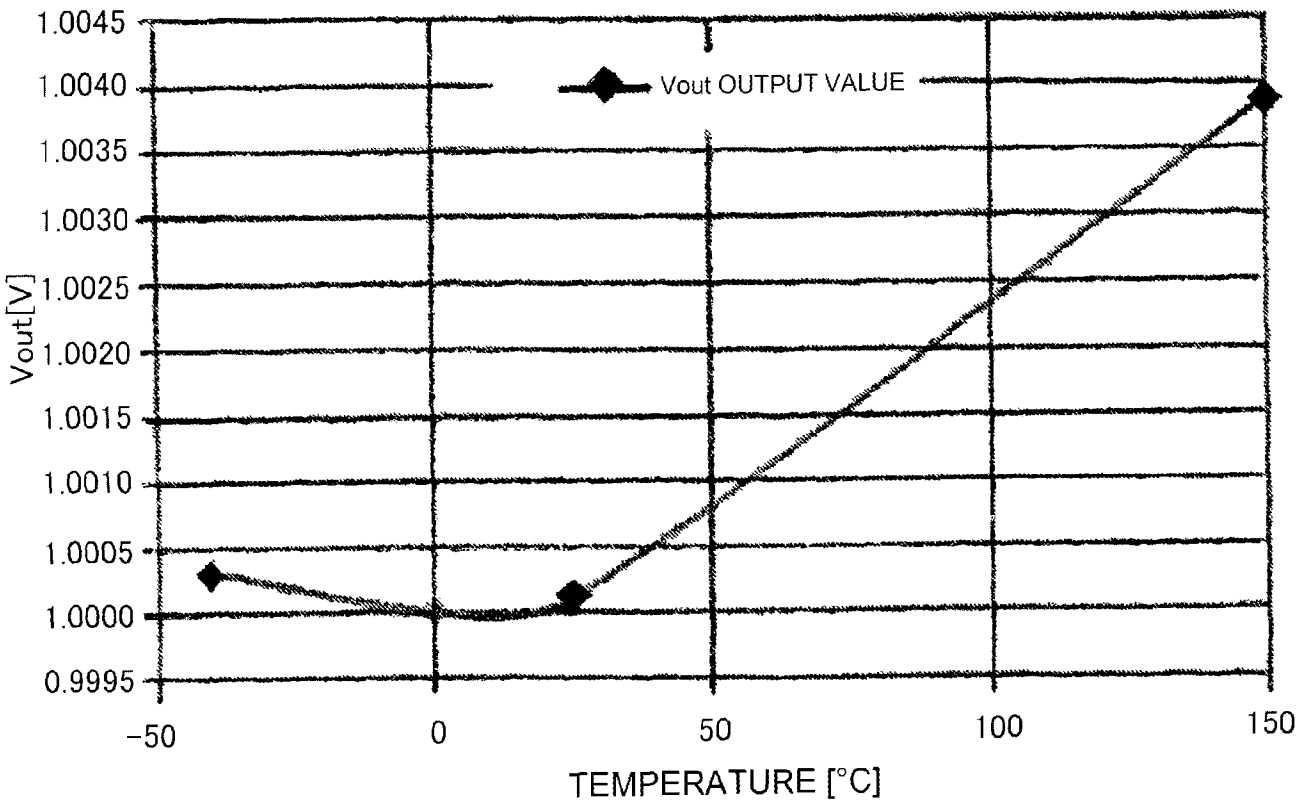
FIG. 8 is a diagram showing fluctuation characteristics of the reference voltage Vref, which is the output voltage Vout of the reference voltage circuit, when the voltage division resistance rate has the ideal temperature characteristics.

Consequently, assuming that the resistance voltage division ratio in the resistance voltage divider circuit 16 manifests the ideal temperature characteristics obtained by calculation and shown in FIG. 6, the error ΔVout of the output voltage Vout changes as shown in FIG. 7, and the output voltage Vout changes as shown in FIG. 8. As shown in each of FIG. 7 and FIG. 8, provided that the resistance voltage division ratio N of the resistance voltage divider circuit 16 is caused to have the ideal temperature characteristic $f_n(T)$, as heretofore described, the error rate can be restricted to within approximately 0.4% (±0.2%), and the output voltage Vout obtained at high accuracy.

In this way, the reference voltage circuit 10 according to the invention is such that a constant current is caused to flow into the Zener diode 11 via the bias current circuit 12 formed of a MOSFET, because of which the predetermined breakdown voltage Vzd is generated in the Zener diode 11, as shown in FIG. 1. Consequently, the Zener diode 11 in the constant voltage circuit 13 stably generates the predetermined breakdown voltage Vzd regardless of change in a drive voltage (VB−VS), which is the difference between the reference potential VS applied to the reference voltage circuit 10 and the power supply voltage VB.

On this basis, the resistance voltage divider circuit 16 resistively divides the breakdown voltage Vzd of the Zener diode 11, thereby generating the reference voltage Vref as the output voltage Vout. In particular, the resistance voltage divider circuit 16, as previously mentioned, has the temperature characteristic $f_n(T)$, which is the reverse of the output temperature characteristic $f_{ZD}(T)$ of the Zener diode 11, because of which temperature change of the reference voltage Vref is canceled out, and a constant reference voltage Vref unconnected with temperature change is stably generated. As a result of this, the temperature dependency of the reference voltage circuit 10 can be zero (0).

Also, according to the heretofore described configuration, no depletion type MOSFET is used, unlike existing technology, because of which the manufacturing process cost thereof can be reduced, and there is no occurrence of the existing problem of malfunction, as occurs when using a bipolar transistor. Consequently, even when incorporating the reference voltage circuit 10 in the control circuit, or the like, that carries out a high side floating operation in the previously mentioned power converter, there is no concern about malfunction, and a constant reference voltage Vref can be stably generated under wide operating conditions. Therefore, a large number of practical advantages are obtained, such as being widely applicable to various kinds of electronic circuit.

Herein, when installing the reference voltage circuit 10 according to the invention in a drive control circuit, for example, a power supply IC or the like, in the previously mentioned power converter, it cannot be denied that a certain amount of error occurs in the resistance values R1 and R2 of the first and second resistors 14 and 15 due to manufacturing error. Consequently, when taking this kind of manufacturing error into account, it is desirable that a trimming circuit 17 is provided in the resistance voltage divider circuit 16, as shown in, for example, FIG. 9.

Figure 10:
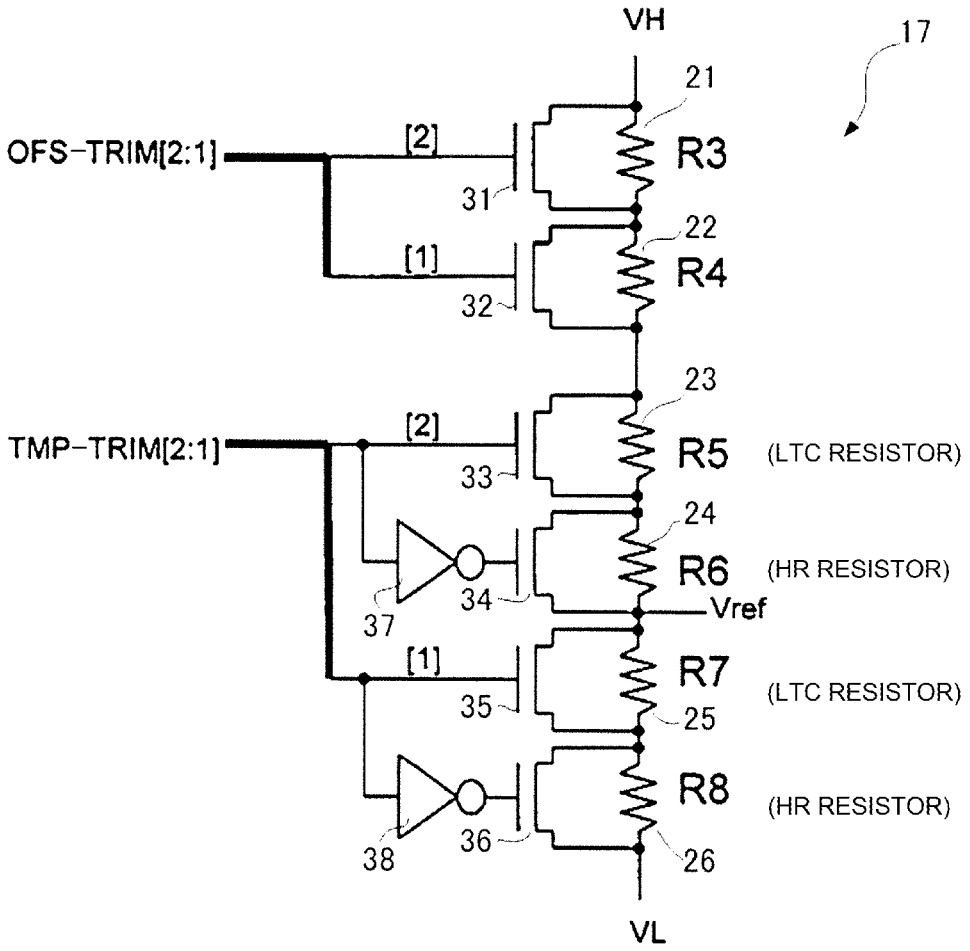
FIG. 10 is a diagram showing a basic configuration of the trimming circuit.

Specifically, the trimming circuit 17, configured as shown in, for example, FIG. 10, is interposed between the first resistor 14 and second resistor 15, specifically between the LTC resistor and HR resistor, in the resistance voltage divider circuit 16. Further, the configuration is such that the reference voltage Vref is obtained via the trimming circuit 17. That is, the trimming circuit 17 is formed of third to eighth resistors 21 to 26 of resistance values R3 to R8 sequentially connected in series, and switch elements 31 to 36, formed of bypass MOSFETs, connected in parallel to the resistors 21 to 26 respectively.

Of the resistors 21 to 26, the third and fourth resistors 21 and 22 are formed of HR resistors for offset regulation, and are selectively interposed between the first and second resistors 14 and 15 by setting the bypass switch elements 31 and 32 so as to be turned off. Also, the fifth to eighth resistors 23 to 26 are formed of two resistor pairs formed of an LTC resistor and HR resistor of the same resistance value. The fifth and sixth resistors 23 and 24 and seventh and eighth resistors 25 and 26 that form the pairs are for regulating a temperature coefficient that corrects relative variation of the first and second resistors 14 and 15.

The fifth and sixth resistors 23 and 24 are alternatively interposed on the first resistor 14 side between the first and second resistors 14 and 15 by opposing on/off settings of the bypass switch elements 33 and 34. Also, the seventh and eighth resistors 25 and 26 are alternatively interposed on the second resistor 15 side between the first and second resistors 14 and 15 by opposing on/off settings of the bypass switch elements 35 and 36.

Herein, the switch elements 31 and 32 are set so as to be selectively turned on and off by an n-bit, for example 2-bit, control signal OFS-TRIM that instructs offset regulation. Also, the switch elements 33 to 36 are set so as to be selectively turned on and off by an m-bit, for example 2-bit, control signal TMP-TRIM that sets a temperature coefficient.

More specifically, the upper one bit of the, for example, 2-bit control signal TMP-TRIM is applied to the gate of the switch element 33, and applied to the gate of the switch element 34 via a NOT circuit 37. Consequently, when the upper one bit of the control signal TMP-TRIM is at an "H" level, the switch element 33 is set so as to be turned on, and the fifth resistor 23 of the resistance value R5 formed of an LTC resistor is bypassed. Also, the sixth resistor 24 of the resistance value R6 formed of an HR resistor is interposed in series with the first resistor 14 of the resistance value R1 formed of an LTC resistor.

Further, when the upper one bit of the control signal TMP-TRIM is at an "L" level, the switch element 34 is set so as to be turned on, and the sixth resistor 24 of the resistance value R6 formed of an HR resistor is bypassed. Further, the fifth resistor 23 of the resistance value R5 formed of an LTC resistor is interposed in series with the first resistor 14 of the resistance value R1 formed of an LTC resistor.

Also, the lower one bit of the 2-bit control signal TMP-TRIM is applied to the gate of the switch element 35, and applied to the gate of the switch element 36 via a NOT circuit 38. Consequently, when the lower one bit of the control signal TMP-TRIM is at an "H" level, the switch element 35 is set so as to be turned on, and the seventh resistor 25 of the resistance value R7 formed of an LTC resistor is bypassed. At the same time, the eighth resistor 26 of the resistance value R8 formed of an HR resistor is interposed in series with the second resistor 15 of the resistance value R2 formed of an HR resistor.

Further, when the lower one bit of the control signal TMP-TRIM is at an "L" level, the switch element 36 is set so as to be turned on, and the eighth resistor 26 of the resistance value R8 formed of an HR resistor is bypassed, and the seventh resistor 25 of the resistance value R7 formed of an LTC resistor is interposed in series with the second resistor 15 of the resistance value R2 formed of an HR resistor.

Consequently, the upper voltage side resistance in the resistance voltage divider circuit 16 is that when the fifth or sixth resistor 23 or 24 is alternatively connected to the first resistor 14 in accordance with the upper one bit of the control signal TMP-TRIM. Therefore, the temperature characteristic (resistance temperature coefficient) of the upper voltage side resistance in the resistance voltage divider circuit 16 is selectively set to zero (0) or the temperature characteristic (resistance temperature coefficient) of the sixth resistor 24.

Also, the lower voltage side resistance in the resistance voltage divider circuit 16 is set as that when the seventh or eighth resistor 25 or 26 is alternatively connected to the second resistor 15 in accordance with the lower one bit of the control signal TMP-TRIM. Therefore, the resistance temperature coefficient of the lower voltage side resistance in the resistance voltage divider circuit 16 is selectively set as the resistance temperature coefficient of the second resistor 15, or a resistance temperature coefficient that is the resistance temperature coefficients of the second and eighth resistors 15 and 26 added together.

As the resistance values of the fifth resistor 23 formed of an LTC resistor and the sixth resistor 24 formed of an HR resistor are set to be equal, the upper voltage side resistance value in the resistance voltage divider circuit 16 does not change in accordance with the control signal TMP-TRIM. In the same way, as the resistance values of the seventh resistor 25 formed of an LTC resistor and the eighth resistor 26 formed of an HR resistor are set to be equal, the lower voltage side resistance value in the resistance voltage divider circuit 16 does not change in accordance with the control signal TMP-TRIM. Consequently, without changing the resistance voltage division ratio of the resistance voltage divider circuit 16, the setting of the resistance temperature coefficient thereof is changed in accordance with the control signal TMP-TRIM. Further, in accompaniment to this, the temperature coefficient of the resistance voltage divider circuit 16 is regulated by trimming.

When more finely regulating the temperature coefficient of the resistance voltage divider circuit 16 by trimming, it is sufficient, for example, to add a pair of an LTC resistor and HR resistor with equal resistance values in series to each of the upper voltage side and lower voltage side of the resistance voltage divider circuit 16. Further, it is sufficient to configure so that the bit number m of the control signal TMP-TRIM is increased in response to these resistor pairs, and one of the LTC resistor and HR resistor forming each of the pairs is alternatively connected in series to the first and second resistors 14 and 15. At this time, taking the bit number m to be 2k (k is a positive integer), the temperature coefficient can be finely regulated in accordance with the bit number m of the control signal TMP-TRIM by performing weighting of, for example, $2^k$ times on the resistance value of each resistor pair, corresponding to each bit of the control signal TMP-TRIM.

Figure 11:
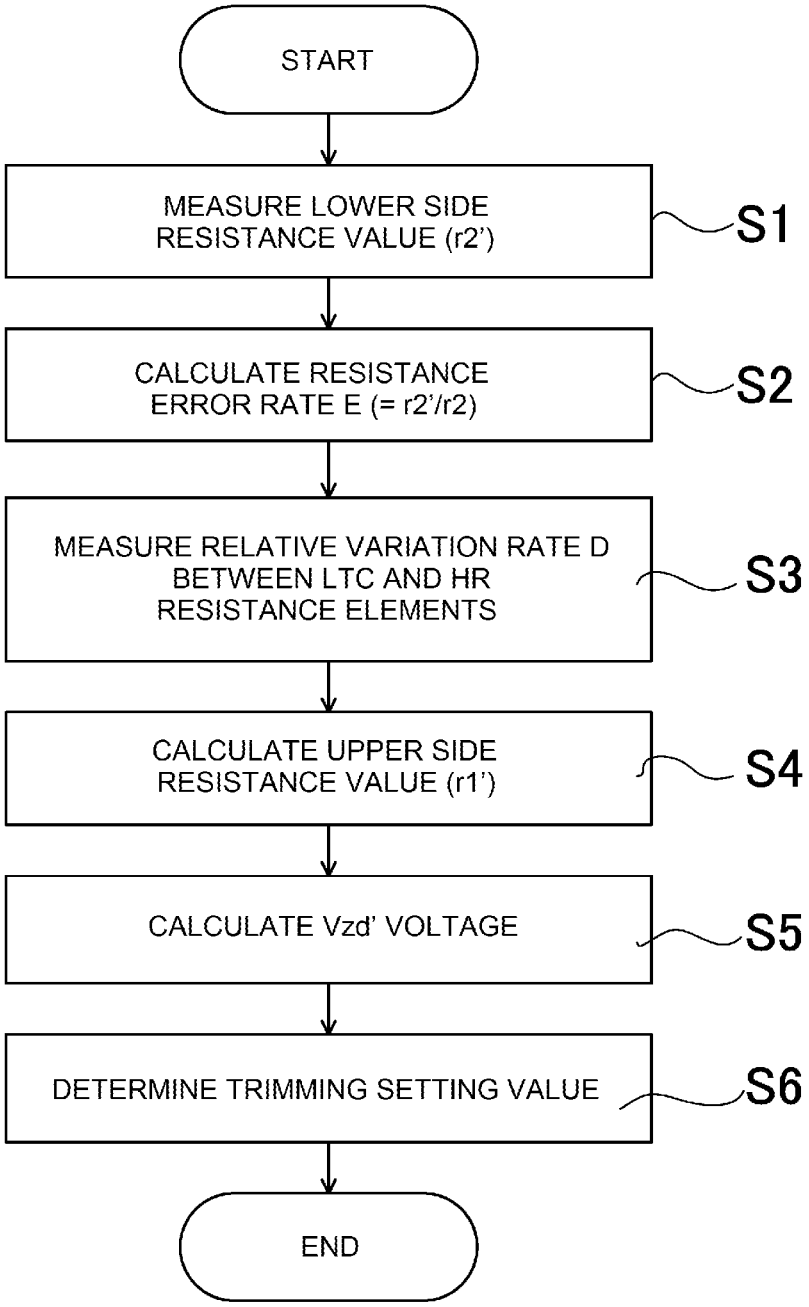
FIG. 11 is a diagram showing an example of a trimming setting procedure.

Herein, while referring to FIG. 11, a description will be given of an example of a procedure of trimming the temperature coefficient. The temperature coefficient trimming is such that, firstly, the power supply voltage VB applied to the reference voltage circuit 10 is interrupted, thereby setting so that no current flows through the resistance voltage divider circuit 16, including the trimming circuit 17, from the power supply voltage VB to the reference potential VS. In this state, a predetermined constant current Itrm is injected from the output terminal that obtains the output voltage Vout of the trimming circuit 17, thereby measuring a voltage Vtrm generated on the lower voltage side of the resistance voltage divider circuit 16.

Then, an actual resistance value r2' (=Vtrm/Itrm) on the lower voltage side of the resistance voltage divider circuit 16 is measured from the voltage Vtrm and constant current Itrm (step S1). The actual resistance value r2' obtained in this way is the resistance value of the series circuit of the second resistor 15 of the resistance value R2 formed of an HR resistor, shown in FIG. 9, and the seventh resistor 25 of the resistance value R7 formed of an LTC resistor and eighth resistor 26 of the resistance value R8 formed of an HR resistor in the trimming circuit 17, shown in FIG. 10. Based on this, reference is made to a design value r2 of the resistance set on the lower voltage side of the resistance voltage divider circuit 16, including the trimming circuit 17, when realizing the reference voltage circuit 10 shown in FIG. 9. Further, a resistance error rate E (=r2'/r2) caused by the manufacturing process is calculated from the resistance design value r2 and the actual resistance value r2' (step S2).

Next, a relative variation rate D between the LTC resistor and HR resistor is obtained (step S3). Measurement of the relative variation rate D is carried out by setting the offset regulation 2-bit control signal OFS-TRIM to "11", thereby bypassing the third and fourth resistors 21 and 22. Based on this, firstly, the 2-bit control signal TMP-TRIM is set to "10", thereby short-circuiting the fifth resistor 23, which is the upper voltage side LTC resistor, and short-circuiting the eighth resistor 26, which is the lower voltage side HR resistor. Then, in this state, the predetermined constant current Itrm is injected from the output terminal that obtains the output voltage Vout of the trimming circuit 17, thereby measuring a voltage Vout1 generated on the lower voltage side of the resistance voltage divider circuit 16.

Furthermore, the 2-bit control signal TMP-TRIM is set to "01", thereby short-circuiting the sixth resistor 24, which is formed of the upper voltage side HR resistor, and short-circuiting the seventh resistor 25, which is formed of the lower voltage side LTC resistor. Then, in this state, the predetermined constant current Itrm is injected from the output terminal that obtains the output voltage Vout of the trimming circuit 17, thereby measuring a voltage Vout2 generated on the lower voltage side of the resistance voltage divider circuit 16.

In this case, as previously mentioned, the fifth to eighth resistors 23 to 26 differ only in being LTC resistors or FIR resistors, and the resistance values acting as design values are set to be mutually equal. Consequently, the voltage Vout1 generated in the series circuit of the seventh resistor 25 of the resistance value R7 formed of an LTC resistor and the second resistor 15 of the resistance value R2 formed of an HR resistor, and the voltage Vout2 generated in the series circuit of the eighth resistor 26 of the resistance value R8 formed of an FIR resistor and the second resistor 15 of the resistance value R2 formed of an FIR resistor, are ideally equal.

In actuality, however, a voltage difference ΔV occurs between the voltage Vout1 and voltage Vout2 due to variation in the manufacturing processes of each resistance element. In other words, the voltage difference ΔV is caused by relative variation between the fifth to eighth resistors 23 to 26. Consequently, the relative variation rate D is obtained as, for example, $$D = \text{Vout1}/\text{Vout2}.$$

Then, in accordance with the actual resistance value r2' obtained in step S1 and the resistance error rate E, and the relative variation rate D between the LTC resistor and FIR resistor obtained in step S3, an upper voltage side actual resistance value r1' in the resistance voltage divider circuit 16 is calculated as $$r1' = (r1/r2) \times r2' \times D$$
$$= r1 \times E \times D$$

(step S4).

Figure 9:
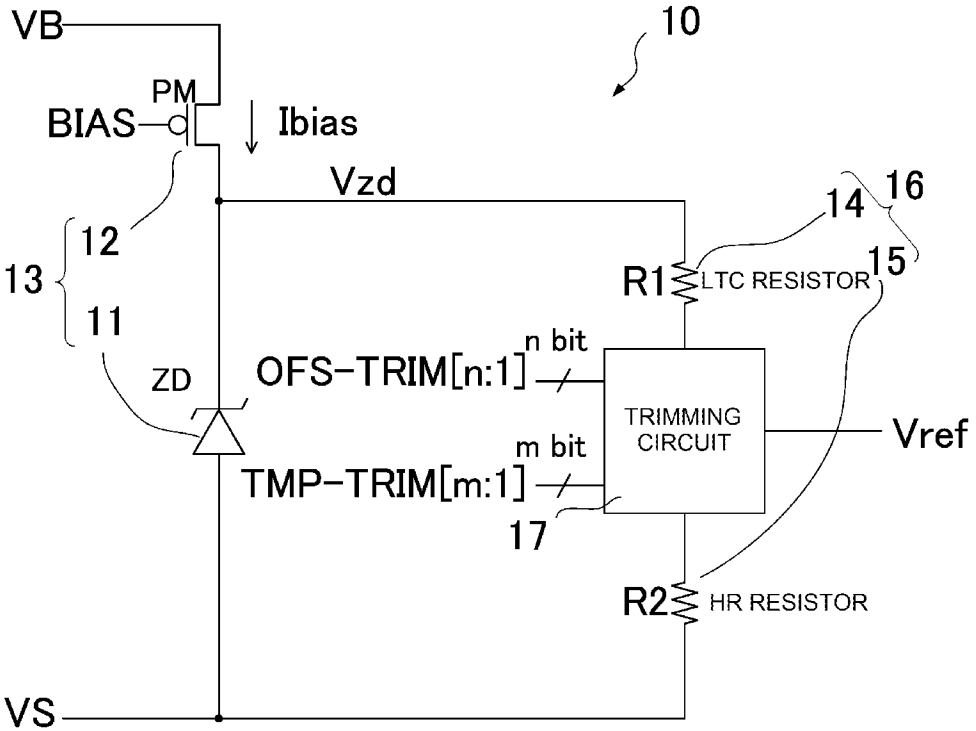
FIG. 9 is a schematic configuration diagram of a reference voltage circuit including a trimming circuit according to a second embodiment of the invention.

Note that the actual resistance value r1' obtained here is the resistance value of the series circuit of the first resistor 14 of the resistance value R1 formed of an LTC resistor, shown in FIG. 9, and the fifth resistor 23 of the resistance value R5 formed of an LTC resistor and sixth resistor 24 of the resistance value R6 formed of an FIR resistor in the trimming circuit 17, shown in FIG. 10. Also, as the fifth to eighth resistors 23 to 26 differ only in being LTC resistors or FIR resistors, as previously mentioned, calculation of the actual resistance value r1' is carried out on the premise that the resistance values acting as design values are mutually equal.

Next, from the actual resistance values r1' and r2' obtained as heretofore described and the voltage Vtrm obtained at the output terminal, a voltage Vzd' applied to the resistance voltage divider circuit 16, including the trimming circuit 17, is inversely calculated as $$Vzd' = (r1' + r2')/r2' \times \text{Vtrm}$$

(step S5). Based on this, the 2-bit control signal IMP-TRIM is obtained as a trimming setting value from the actual resistance values r1' and r2' and the voltages Vtrm and Vzd', referring to, for example, an unshown trimming table obtained in advance as a circuit simulation result (step S6).

Then, the switch elements 33 to 36 are selectively set so as to be turned on and off in accordance with the 2-bit control signal TMP-TRIM, whereby the fifth to eighth resistors 23 to 26 are selectively interposed between the first and second resistors 14 and 15, and trimming of the temperature coefficient is executed. Specifically, the fifth resistor 23 formed of an LTC resistor or the sixth resistor 24 formed of an HR resistor is selectively connected in series with the first resistor 14 formed of an LTC resistor. Furthermore, the seventh resistor 25 formed of an LTC resistor or the eighth resistor 26 formed of an HR resistor is selectively connected in series with the second resistor 15 formed of an HR resistor, and trimming of the temperature coefficient of the resistance voltage divider circuit 16 is carried out.

According to the reference voltage circuit 10 configured to include the trimming circuit 17, the temperature characteristic $f_n(T)$ of the resistance voltage division ratio N of the resistance voltage divider circuit 16 can be set with high accuracy in accordance with the temperature characteristic $f_{ZD}(T)$ of the Zener diode 11. As a result of this, temperature change of the breakdown voltage Vzd generated in the Zener diode 11 can be compensated for with high accuracy, and the output voltage Vout of the resistance voltage divider circuit 16, that is, the constant reference voltage Vref, can be stably obtained, regardless of temperature change.

Figure 12:
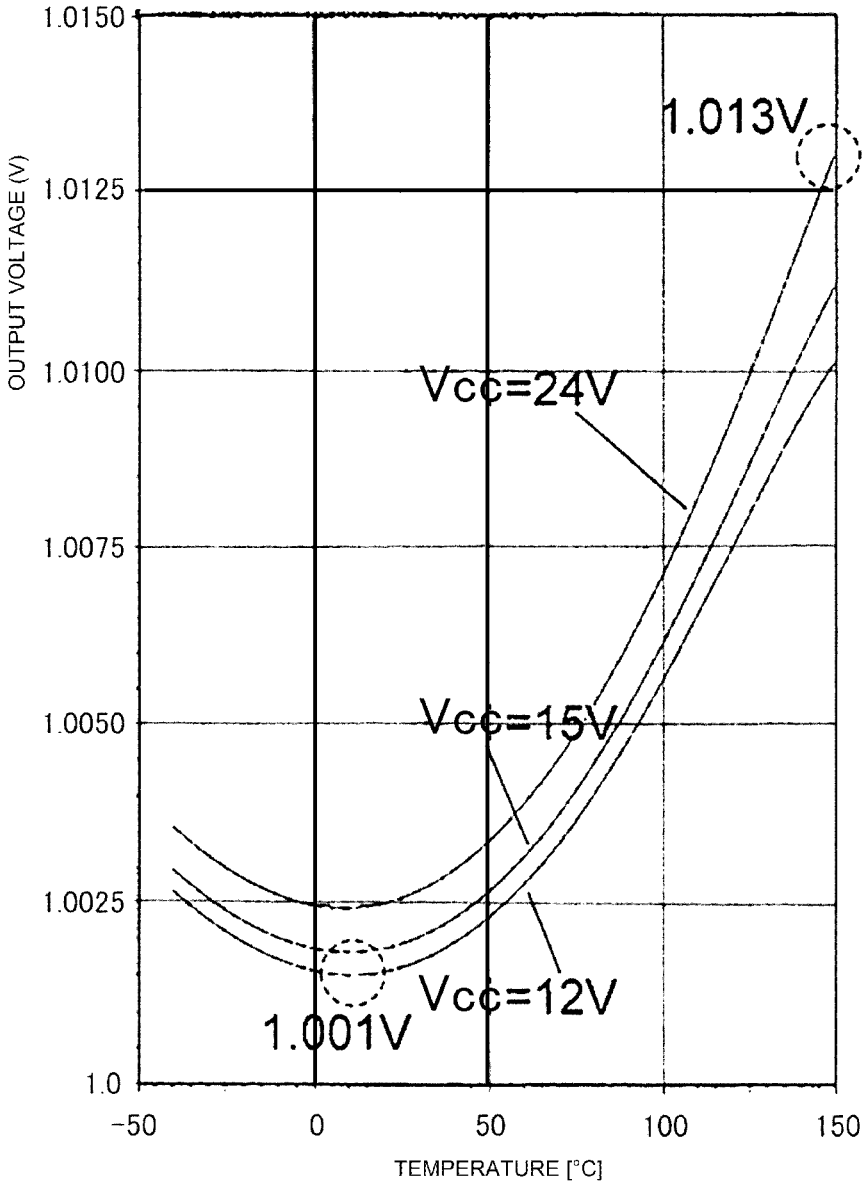
FIG. 12 is a diagram showing simulation results of the reference voltage circuit according to the invention set for trimming.
Figure 13:
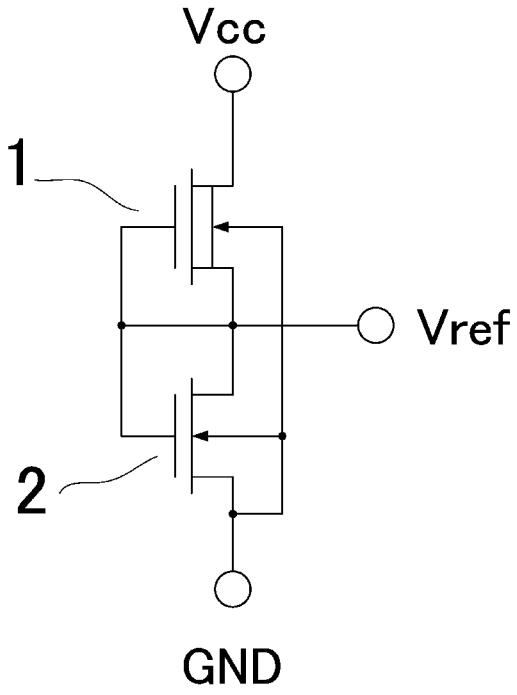
FIG. 13 is a diagram showing a configuration example of an existing reference voltage circuit using a depletion type MOSFET and an enhancement type MOSFET.
Figure 14:
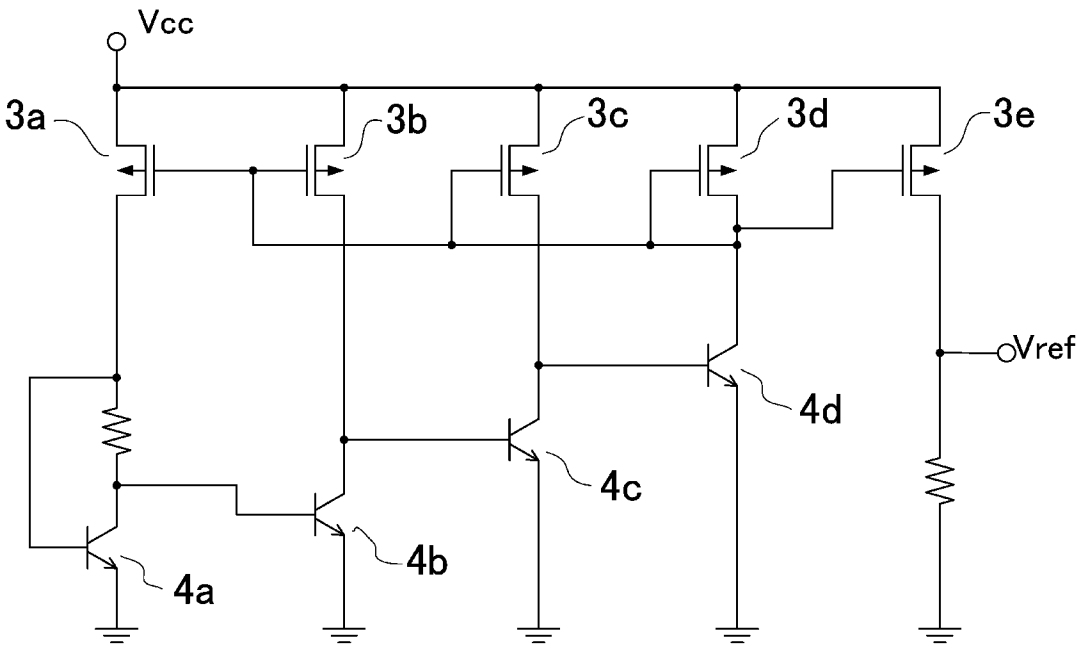
FIG. 14 is a diagram showing a configuration example of an existing reference voltage circuit using an enhancement type MOSFET and a bipolar transistor.

FIG. 12 is simulation results showing change in the output voltage Vout when the power supply voltage applied to the reference voltage circuit 10 is changed between 12V and 24V. As shown by the simulation results, the output voltage Vout only changes within a range of 1.001V (minimum value) to 1.013V (maximum voltage) under conditions wherein the power supply voltage changes within a range of 12V to 24V, even when the ambient temperature thereof changes within a range of −40° C. to 150° C. Consequently, it can be confirmed that, under the fluctuating power supply voltage and temperature conditions, the fluctuation error of the reference voltage Vref, which is the output voltage Vout, is restricted to 1.3% or less and stably obtained.

The invention is not limited by the heretofore described embodiments. For example, the trimming circuit 17 can, of course, be configured without the offset regulation third and fourth resistors 21 and 22. Also, as previously mentioned, the pairs of temperature coefficient correction LTC resistors and HR resistors in the trimming circuit 17 can be further increased. Furthermore, with regard to voltage generated in the constant voltage circuit 13, it is sufficient to use the Zener diode 11 having breakdown voltage characteristics in accordance with the voltage specifications. In addition to this, various modifications are possible without departing from the scope of the invention.

The invention claimed is:

1. A reference voltage circuit, comprising:

a constant voltage circuit, including a Zener diode, and a bias current circuit connected in series with the Zener diode and causing a constant current to flow into the Zener diode, the constant voltage circuit being interposed between a reference potential and a power supply voltage, to thereby generate a predetermined breakdown voltage in the Zener diode; and a resistance voltage divider circuit connected in parallel with the Zener diode to divide the breakdown voltage generated in the Zener diode, to thereby generate a reference voltage, wherein the resistance voltage divider circuit includes first and second resistors connected in series, the first resistor is connected to a cathode side of the Zener diode, and is formed of a low temperature coefficient resistor body that is temperature-independent, and the second resistor is connected to an anode side of the Zener diode, and is formed of a resistor body having temperature characteristics that are the reverse of output temperature characteristics of the Zener diode, wherein the temperature characteristics of the resistor body include a resistance value of the resistor body at each temperature in a range of temperatures, and the output temperature characteristics of the Zener diode include the breakdown voltage generated in the Zener diode at each temperature in the range of temperatures.

2. The reference voltage circuit according to claim 1, wherein the bias current circuit is formed of a MOSFET (metal-oxide-semiconductor field-effect transistor) driven by a predetermined bias voltage applied thereto.

3. The reference voltage circuit according to claim 1, further comprising a trimming circuit configured to regulate resistance values of the first and second resistors in the resistance voltage divider circuit.

4. The reference voltage circuit according to claim 3, wherein the first resistor includes a plurality of first resistor bodies;

the second resistor includes a plurality of second resistor bodies; and the trimming circuit includes a first group of switch elements that are connected in series and that selectively bypass the plurality of first resistor bodies forming the first resistor, and a second group of switch elements that are connected in series and that selectively bypass the plurality of second resistor bodies forming the second resistor.

5. The reference voltage circuit according to claim 4, wherein each of the switch elements is a MOSFET (metal-oxide-semiconductor field-effect transistor) that is turned on and off in accordance with a trimming control signal provided from an exterior.

6. A reference voltage circuit, comprising:

a constant voltage circuit, including a Zener diode, and a bias current circuit connected in series with the Zener diode and causing a constant current to flow into the Zener diode, the constant voltage circuit being interposed between a reference potential and a power supply voltage, to thereby generate a predetermined breakdown voltage in the Zener diode;

a resistance voltage divider circuit connected in parallel with the Zener diode to divide the breakdown voltage generated in the Zener diode, to thereby generate a reference voltage, wherein the resistance voltage divider circuit includes first and second resistors connected in series, the first resistor being connected to a cathode side of the Zener diode, the second resistor being connected to an anode side of the Zener diode, and the first and second resistors include a plurality of pairs of resistor bodies, each pair including a first resistor body that is formed of a low temperature coefficient resistor body that is temperature-independent, and a second resistor body that is formed of the resistor body having temperature characteristics that are the reverse of output temperature characteristics of the Zener diode; and a trimming circuit configured to regulate resistance values of the first and second resistors in the resistance voltage divider circuit, the trimming circuit selectively bypassing one of the first and second resistor bodies forming each pair.

7. The reference voltage circuit according to claim 6, wherein The first and second resistor bodies in each pair have different resistance values.

8. The reference voltage circuit of claim 1, wherein the resistance voltage divider circuit is free of a diode connected between the second resistor and the anode side of the Zener diode.

9. A reference voltage circuit, comprising:

a Zener diode, and a bias current circuit connected in series with the Zener diode, and being configured to cause a constant current to flow into the Zener diode; and first and second resistors, first ends thereof being connected to each other, second ends thereof being respectively connected to cathode and anode sides of the Zener diode, the first resistor being temperature-independent, temperature characteristics of the second resistor being the reverse of output temperature characteristics of the Zener diode, wherein the temperature characteristics of the second resistor include a resistance value of the second resistor at each temperature in a range of temperatures, and the output temperature characteristics of the Zener diode include a breakdown voltage generated in the Zener diode at each temperature in the range of temperatures.

10. The reference voltage circuit according to claim 9, further comprising a trimming circuit configured to regulate resistance values of the first and second resistors.

* * * * *